US006585406B2

(12) United States Patent
Toepper et al.

(10) Patent No.: US 6,585,406 B2
(45) Date of Patent: Jul. 1, 2003

(54) ELECTROSTATOGRAPHIC BLENDER ASSEMBLY AND METHOD

(75) Inventors: John P. Toepper, Rochester, NY (US); Paul E. Thompson, Webster, NY (US); Gerald M. Darby, Brockport, NY (US); Kenneth M. Patterson, Hilton, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 79 days.

(21) Appl. No.: 09/853,725

(22) Filed: May 11, 2001

(65) Prior Publication Data

US 2001/0046182 A1 Nov. 29, 2001

Related U.S. Application Data

(60) Provisional application No. 60/204,880, filed on May 17, 2000.

(51) Int. Cl.[7] ..... B01F 7/08; B01F 7/04

(52) U.S. Cl. ..... 366/320; 366/325.92; 366/331; 399/256

(58) Field of Search ..... 399/254–256; 366/318, 320, 325.92, 331, 330.1–330.7

(56) References Cited

U.S. PATENT DOCUMENTS

| | | | | |
|---|---|---|---|---|
| 2,014,636 | A | | 9/1935 | Posendahl |
| 2,896,925 | A | | 7/1959 | Place |
| 3,696,913 | A | * | 10/1972 | Anders |
| 3,924,835 | A | | 12/1975 | Hohnfeld et al. |
| 3,926,517 | A | | 12/1975 | Nagahara |
| 4,077,756 | A | * | 3/1978 | Meadors |
| 4,405,274 | A | * | 9/1983 | Saitoh et al. |
| 4,610,068 | A | * | 9/1986 | Schultz |
| 4,634,286 | A | | 1/1987 | Pike |
| 4,825,244 | A | | 4/1989 | Hediger |
| 4,887,132 | A | | 12/1989 | Joseph et al. |
| 4,956,675 | A | | 9/1990 | Joseph |
| 5,146,277 | A | | 9/1992 | Fox |
| 5,310,257 | A | * | 5/1994 | Altieri, Jr. et al. |
| 5,476,319 | A | * | 12/1995 | Blach |
| 5,524,982 | A | | 6/1996 | Kruse et al. |
| 5,812,916 | A | | 9/1998 | Kishimoto et al. |
| 5,923,931 | A | | 7/1999 | Kishimoto |

FOREIGN PATENT DOCUMENTS

| | | |
|---|---|---|
| EP | 0 250 793 A2 | 1/1988 |

* cited by examiner

*Primary Examiner*—Charles E. Cooley
*Assistant Examiner*—David Sorkin
(74) *Attorney, Agent, or Firm*—Kevin L. Leffel

(57) ABSTRACT

The invention relates generally to development apparatus for mixing and applying developer material to a latent image on an image-bearing member in an electrostatographic reproduction machine, such as a copier or printer. More particularly, this invention relates to a blender of the type for mixing electrostatographic developer comprising a plurality of blender segments mounted on a shaft. A resilient spacer is provided, according to an aspect of the invention, wherein said resilient spacer and said plurality of blender segments are compressed between said pair of stops. Residual looseness due to tolerance stack-up is eliminated.

20 Claims, 4 Drawing Sheets

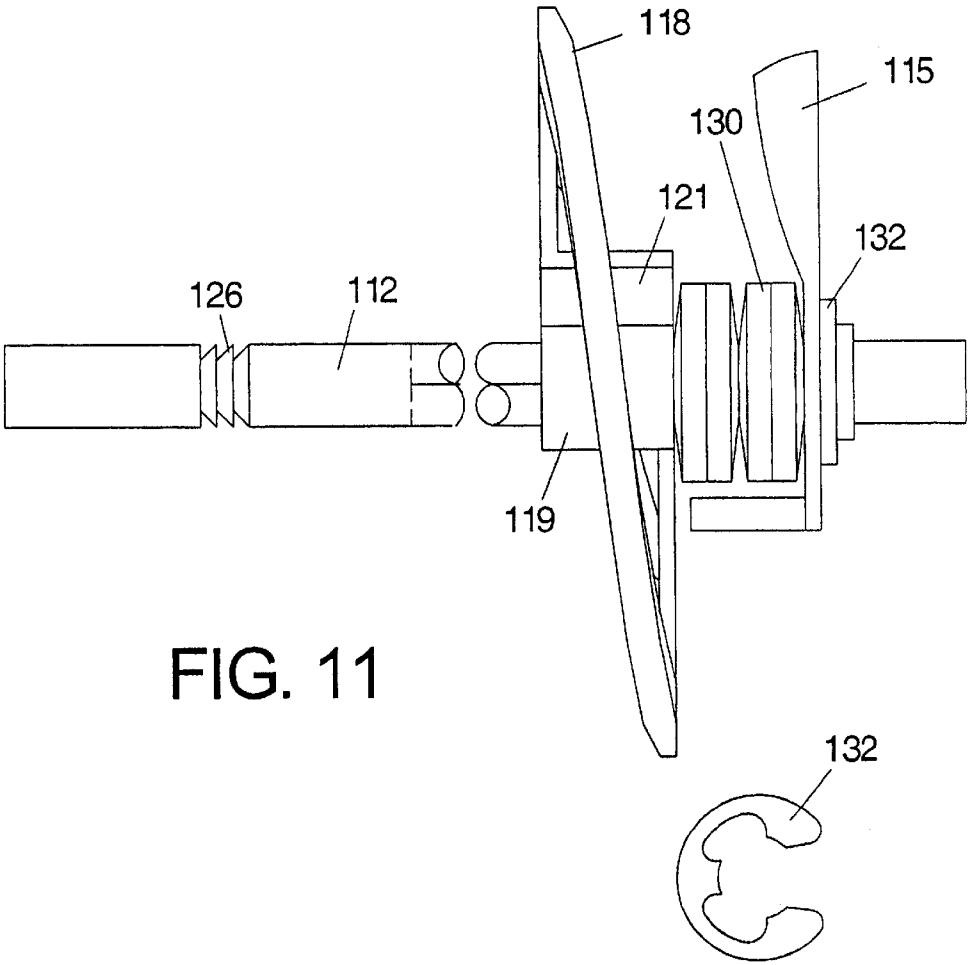
FIG. 11
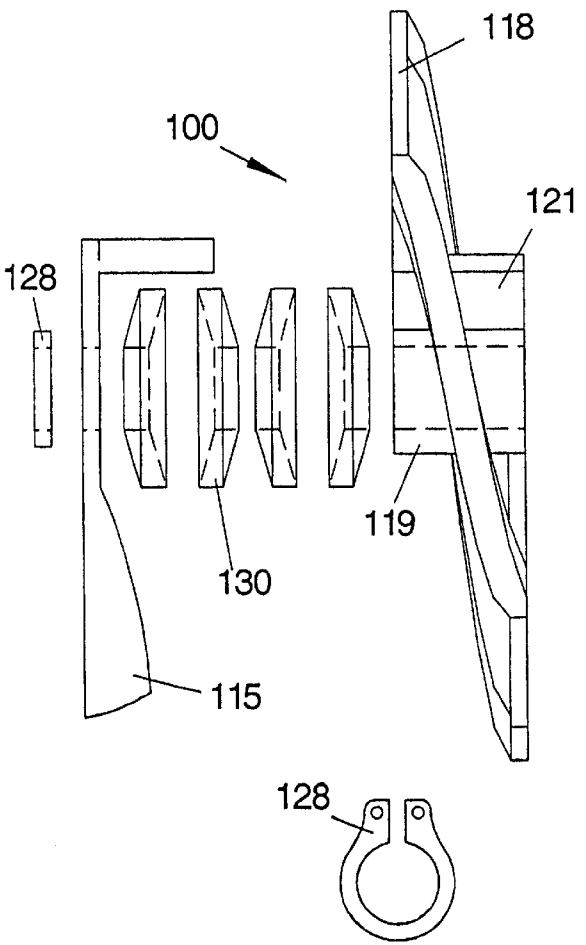
FIG. 12
FIG. 13

ELECTROSTATOGRAPHIC BLENDER ASSEMBLY AND METHOD

This application claims the benefit of U.S. Provisional Application No. 60/204,880 filed May, 17, 2000.

This invention relates generally to development apparatus for mixing and applying developer material to a latent image on an image-bearing member in an electrostatographic reproduction machine, such as a copier or printer. More particularly, this invention relates to a blender of the type for mixing electrostatographic developer comprising a plurality of blender segments mounted on a shaft.

Development apparatus, for example a magnetic brush development apparatus, are well known for mixing and applying developer material to a latent electrostatic image on a photoconductor in an electrostatographic reproduction machine such as a copier or printer. Such a development apparatus typically includes an elongate housing which has a sump portion for containing the developer material. A two-component developer material comprises a mixture of carrier particles and toner particles. These particles are usually moved and mixed by a mixing device in the sump portion of the housing for triboelectrically charging the particles. Mixing also promotes uniformity in the concentration of toner particles throughout the sump portion, and in the distribution of developer material within the sump. The mixed and charged developer material can then be fed from the sump portion for development of the latent image on the photoconductor, which is generally a film or drum.

The quality of such an image development depends, in significant part, on factors such as the level of charge on the toner particles achieved triboelectrically for example, and such as the level and uniformity of the concentration of toner particles in the developer material being applied. As is well known, these factors are mainly determined by the effectiveness of a mixing device used in the sump portion of the development apparatus housing for moving, mixing and charging the developer material particles.

Certain prior blender assemblies implement a row of blender segments mounted on a shaft. Such assemblies typically exhibit a looseness in the blender segments after assembly due to tolerance stack-up. The segments are able to move small distance relative to the shaft and relative to each other. This movement, although limited, can cause toner flakes in the developer which, in turn, causes objectionable artifacts in the developed image. In addition, the outside diameter of certain blenders is ground during manufacturing to ensure an accurate fit with the developer housing. Looseness in the segments can cause the segments to chatter during the grinding operation.

SUMMARY OF THE INVENTION

According to an aspect of the invention, a blender for mixing electrostatographic developer is provided, comprising a shaft having a pair of stops spaced along a length thereof, a plurality of blender segments of the type for mixing electrostatographic developer, each blender segment having an aperture, the shaft being received within the aperture of each blender segment, and a resilient spacer, wherein the resilient spacer and the plurality of blender segments are compressed between the pair of stops.

According to a further aspect of the invention, a method of fabricating a blender for mixing electrostatographic developer is provided, comprising disposing a resilient spacer and a plurality of blender segments of the type for mixing electrostatographic developer on a shaft, each blender segment having an aperture, the shaft being received within the aperture of each blender segment, and compressing the resilient spacer and the plurality of blender between a pair of stops on the shaft.

According to a still further aspect of the invention a blender for mixing electrostatographic developer is provided, comprising a shaft having a pair of stops spaced along a length thereof and a plurality of serrations, one of the stops comprising a snap ring engaging one of the serrations, a plurality of blender segments of the type for mixing electrostatographic developer, each blender segment having an aperture, the shaft being received within the aperture of each blender segment, and at least one belleville washer disposed immediately adjacent one of the stops, wherein the resilient spacer and the plurality of blender segments are compressed between the pair of stops.

A blender according to the present invention has a plurality of blender segments exhibiting no residual looseness due to tolerance stack-up.

BRIEF DESCRIPTION OF THE DRAWINGS

FIG. 11 presents an enlarged exploded view of the blender of FIG. 6 with parts broken away.

FIG. 12 presents a plan view of a snap ring implemented in the blender of FIG. 6.

FIG. 13 presents a plan view of an e-ring implemented in the blender of FIG. 6.

DETAILED DESCRIPTION

Figure 1:
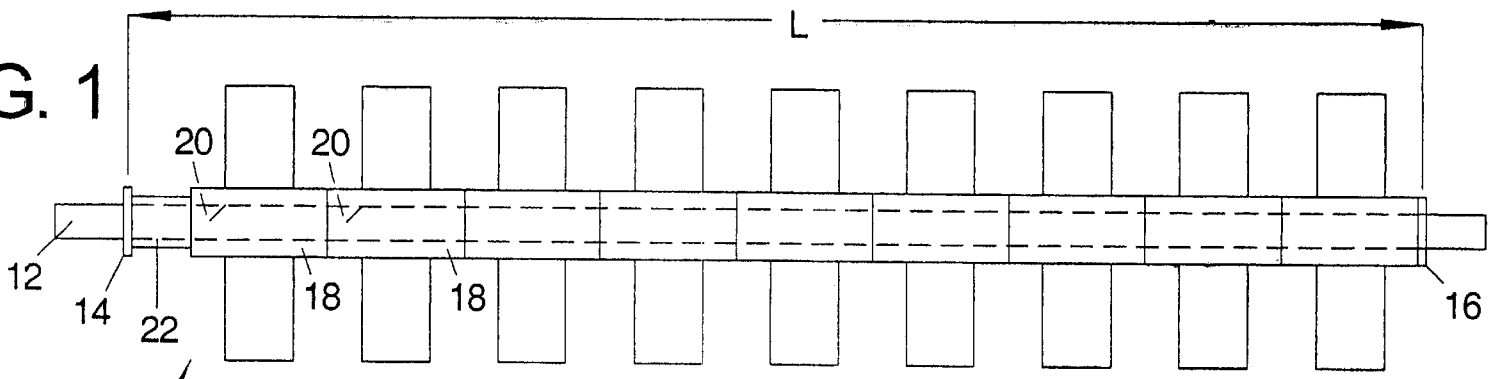
FIG. 1 presents a side view of a blender comprising a plurality of segments according to an aspect of the invention.

Various aspects of the invention are presented in FIGS. 1–14, which are not drawn to scale, and wherein like components are numbered alike. Referring now specifically to FIGS. 1–4, a blender 10 for mixing electrostatographic developer is presented according to an aspect of the invention comprising a shaft 12 having a pair of stops 14 and 16 spaced along a length L. A plurality of blender segments 18 of the type for mixing electrostatographic developer are provided, each blender segment 18 having an aperture 20.

The shaft 12 is received within the aperture 20 of each blender segment 18. A resilient spacer 22 is provided, the resilient spacer 22 and the plurality of blender segments 18 being compressed between the pair of stops 14 and 16.

Figure 2:
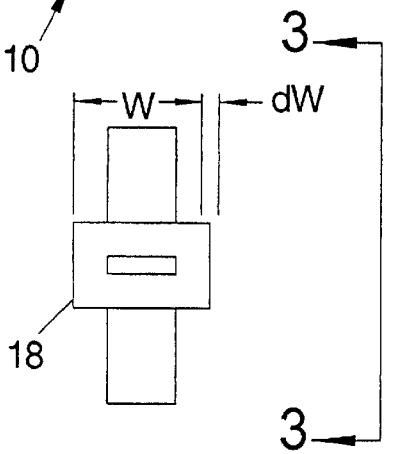
FIG. 2 presents a side view of a blender segment implemented in the blender of FIG. 1, according to an aspect of the invention.
Figure 3:
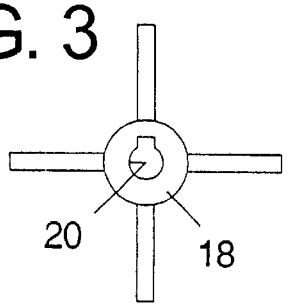
FIG. 3 presents an end view of a blender segment according to an aspect of the invention taken along line 3—3 of FIG. 2.

According to an aspect of the invention, the resilient spacer 22 provides a greater degree of elastic compression than the blender segments 18 and compensates for variations in the width of the row of blender segments 18 induced by tolerance stack-up. Each blender segment 18 is manufactured to prescribed dimensions, each dimension having a tolerance. Of particular interest here, with reference to FIG. 2, is the width W of each blender segment, and the tolerance dW associated with the width W.

The tolerance dW may be expressed in numerous ways as an absolute positive or negative value, or as a positive/negative (+/−), in accordance with the particular tolerance system employed. In any event, each blender segment 18 typically includes a small amount of variation in the manufactured width. Such variation is magnified when several blender segments 18 are placed in a row, a phenomena known as "tolerance stack-up."

The maximum variation in the total width of the row is the sum of the tolerances dW of each blender segment 18 (and the tolerances of any intermediate structures). Since the blender segments 18 are generally manufactured from a relatively incompressible material such as plastic or metal, the length L between the first and second stops 14 and 16 is set to approximately the greatest possible width of the stack. This ensures that all of the blender segments 18 will fit between the stops 14 and 16.

In practice, the actual width of the row of blender segments 18 is usually less than the maximum possible width since the width of each blender segment 18 is usually less than the maximum allowed by the tolerances. If left uncompensated, the individual blender segments 18, after assembly of the blender 10, are able to move a small distance relative to the shaft and relative to each other. This residual looseness is undesirable. The resilient spacer 22 solves this problem by maintaining the blender segments 18 under compression over the relatively large variation in total width induced by tolerance stack-up, thus eliminating the residual looseness. The resilient spacer 22 may comprise a coil spring, a belleville washer, or other resilient structure that compensates for tolerance stack-up in the blender segments 28.

In a typical installation, the blender 10 is mounted in a developer sump and the shaft 12 is rotationally driven about its longitudinal axis. Examples of development apparatus that may implement a blender according to the present invention are described in U.S. Pat. Nos. 4,634,286; 4,825,244; and 4,887,132. While not limited to any particular toner or developer, the present invention is particularly useful with two-component developer that implements a mixture of toner and carrier. Driving the blender 10 in a two-component developer induces tribocharging of the toner and carrier particles. The phenomena of tribocharging is well known in the electrostatographic arts. The blender segments may be configured in numerous ways, including knives, paddles, scoops, and/or ribbons, without limitation.

Figure 5:
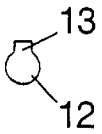
FIG. 5 presents cross-section view of a shaft taken along line 5—5 of FIG. 4.
Figure 4:
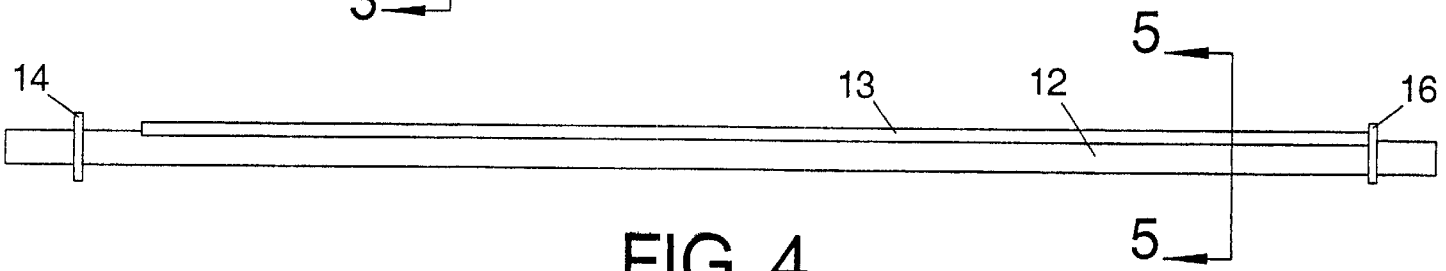
FIG. 4 presents a side view of a shaft implemented in the blender of FIG. 1.

The blender segments 18 are preferably driven by the shaft 12. As best shown in FIG. 5, the shaft 12 may have a key 13 that mates with the apertures 20 of the blender segments 18. The key 13 ensures rotation of the blender segments 18 with the shaft 12, although other geometries that render the shaft 12 and apertures 20 non-circular in cross section may be implemented.

The blender segments 18 may be formed from any suitable material, including plastics and metals. They may be made by molding, casting, machining from bulk material, or any other suitable manufacturing processes for rendering geometries useful in a developer blender.

According to a preferred embodiment, the plurality of blender segments 18 are disposed in seriatim with the resilient spacer 22 adjacent one of the pair of stops 14 and 16, as presented in FIG. 1. In FIG. 1, the resilient spacer 22 is immediately adjacent the stop 14.

Referring now to FIGS. 6–10, an embodiment of a blender 100 for mixing electrostatographic developer is presented, according to a further aspect of the invention. Blender 100 comprises a shaft 112 having a pair of stops 114 and 116 spaced along a length L. A plurality of blender segments 118 of the type for mixing electrostatographic developer are provided, each blender segment 118 having an aperture 120. The shaft 112 is received within the aperture 120 of each the blender segment 118. Resilient spacers 122 and 124 are provided, the resilient spacers 122 and 124 and the plurality of blender segments 118 being compressed between the pair of stops 114 and 116. In the embodiment presented in FIG. 6, the resilient spacer 122 is adjacent the stop 114, and the resilient spacer 124 is adjacent the stop 116. Wipers 115, or other structure, may be provided immediately adjacent the stops 114 and 116, as presented in FIG. 6.

According to a further aspect of the invention, the shaft 112 may comprise a plurality of serrations 126, and one of the stops 114 comprises a snap ring 128 engaging one of the serrations 126. The other stop 116 may also comprise a snap ring 132 engaging a mating groove 134 in the shaft 112.

According to a preferred embodiment, the blender segments 118 form a ribbon blender, and the resilient spacer 122 comprises a plurality of stacked belleville washers 130. One or more additional spacers, such as resilient spacer 124, may also comprise a plurality of stacked belleville washers 130. The blender segments 118 may form a ribbon blender having a double helix 136 and 138.

Various ribbon blenders that may be implemented in the practice of the present invention are described in U.S. Pat. Nos. 4,634,286; 4,956,675; and 5,146,277.

The blender segments 118 are of three general configurations; a first configuration 140 wherein helix 136 is outside helix 138, a second configuration 142 wherein helix 138 is outside 136, and a transition configuration 144 wherein the helixes 138 and 136 switch relative position. This geometry greatly enhances mixing of the developer, as described by U.S. Pat. No. 4,634,286.

Figures 6, 7, 8, 9, 10:
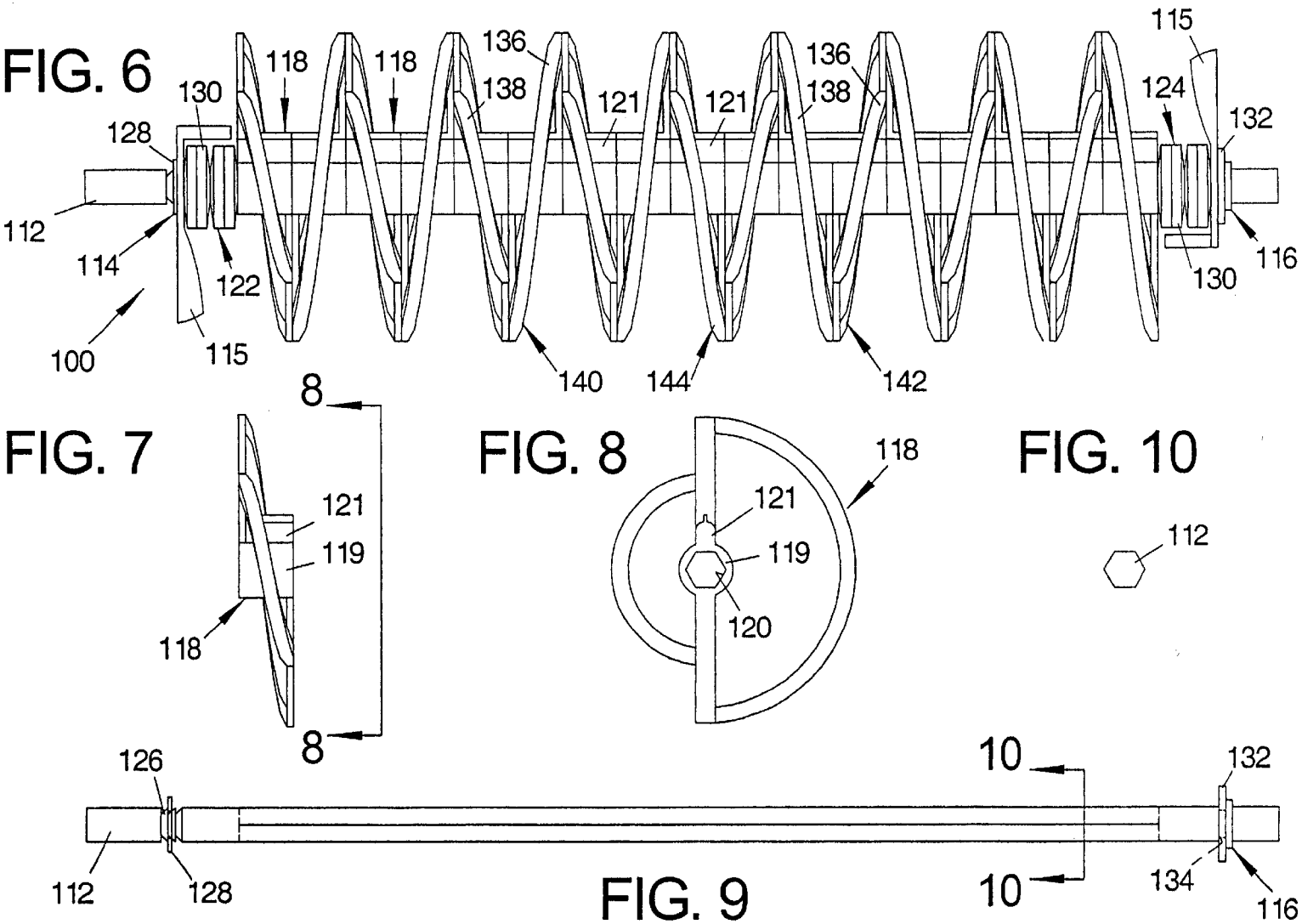
FIG. 6 presents a side view of a blender comprising a plurality of segments according to a further aspect of the invention.
FIG. 7 presents side view of a blender segment according to an aspect of the invention.
FIG. 8 presents an end view of a blender segment according to an aspect of the invention taken along line 8—8 of FIG. 7.
FIG. 9 presents a side view of the shaft implemented in the blender of FIG. 6.
FIG. 10 presents a cross-sectional view of the shaft taken along line 10—10 of FIG. 9.

Referring now specifically to FIGS. 7 and 8, each blender segment 18 comprises a ferrule 119 and an integral rib 121. Referring again to FIG. 6, the individual ribs 121 are aligned and form a rib that runs along the length of the blender segments 118.

Referring again to FIGS. 1–4, a method of fabricating a blender for mixing electrostatographic developer is provided, according to a further aspect of the invention, comprising disposing a resilient spacer 22 and a plurality of blender segments 18 of the type for mixing electrostatographic developer on a shaft 12, each blender segment 18 having an aperture 20, the shaft 12 being received within the aperture of each the blender segment 18, and compressing the resilient spacer 22 and the plurality of blender segments 18 between a pair of stops 14 and on 16 attached to the shaft 12. The method may further comprise disposing the plurality of blender segments 18 in seriatim with the resilient spacer 22 adjacent one of the pair of stops 14 and 16.

Referring again to FIGS. 6–10, one of the stops, stop 114 for example, may comprise a snap ring 128, and the method may further comprise pressing the snap ring 128 toward another of the stops into engagement with one of the plurality of serrations 126.

Referring now to FIG. 11, an enlarged exploded view of blender 100 with portions broken away is presented. Only the left-most blender segment 118 and right-most blender segment of FIG. 6 are presented in FIG. 11 for the sake of clarity. According to a certain embodiment, snap ring 126 is configured as shown in FIG. 12, and snap ring 132 is configured as shown in FIG. 13. Referring again to FIG. 11, blender 100 is fabricated by installing inserting the end of the shaft 112 into the apertures of the belleville washers 130 and the wiper 115. The snap ring 132 is then installed into a mating groove on the shaft 112. The blender segments 118 are installed onto the shaft from the opposite end. The belleville washers 130 on that end are then installed, followed by the wiper 115. The snap ring 128 is then installed on the shaft resting against the wiper 115. The entire assembly is then placed in a press that forces the snap ring 128 onto the serrations 126. A press having a load indicator is preferred in order to avoid overloading the assembly. The snap ring 128 may engage any one of the serrations 126, depending upon the prescribed load.

Figure 14:
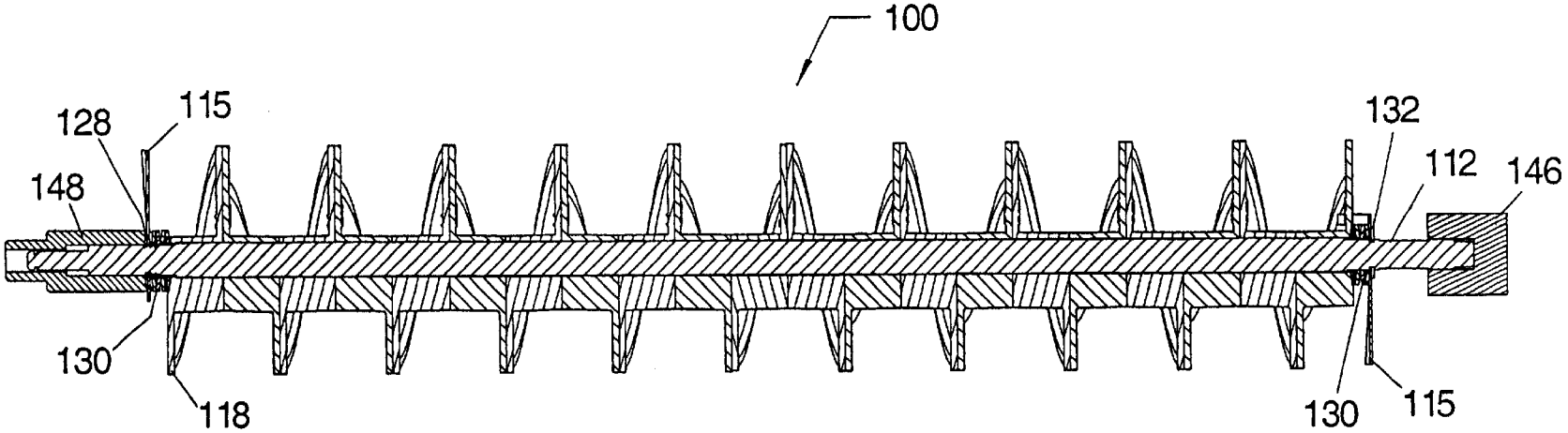
FIG. 14 presents a side cross-sectional view of the blender assembly with tooling for installing the snap ring.

Referring now to FIG. 14, a side-cross sectional view of the blender 100 is presented with tooling that may be employed to press snap ring 128 onto the serrations 126. The end of the shaft 112 proximate the snap ring 132 is placed in a cylindrical end-piece 146. The other end of the shaft 112 proximate the snap ring 128 is placed in a cylindrical end-piece 148, and is pressed toward the end-piece 146. The assembly may be placed in a lathe, for example, and the tail stock may be used to apply the force. The cylindrical end-piece 146 preferably does not contact the snap ring 132.

In a certain embodiment, a blender 100 has twenty-one (21) blender segments having a total nominal width of 14.7 inches. Allowable manufactured width, including tolerances, ranges from 14.616 inches to 14.784 inches (a range of 0.168 inches). Four belleville washers are stacked on each end, as shown in FIG. 11, that provide a total deflection of 0.051 inches at a force of 150 lbf. The length of the section having the serrations is 0.180 inches (three serrations at 0.060 inches per serration). The overall range of adjustment is the sum of 0.180 inches for the serrated section plus 0.051 inches for compression of the belleville washers. This provides more than sufficient adjustment for the 0.168 inches worst case variation due to tolerance stack-up.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

We claim:

1. A blender for mixing electrostatographic developer, comprising:

a shaft having a pair of stops spaced along a length thereof;

a plurality of blender segments, each said blender segment having an aperture, said shaft being received within said aperture of each said blender segment; and, a resilient spacer, wherein said resilient spacer and said plurality of blender segments are compressed between said pair of stops.

2. The apparatus of claim 1, wherein said plurality of blender segments are disposed in seriatim with said resilient spacer adjacent one of said pair of stops.

3. The apparatus of claim 1, wherein said resilient spacer is a spring.

4. The apparatus of claim 1, wherein said resilient spacer comprises at least one belleville washer.

5. The apparatus of claim 1, wherein said shaft comprises a plurality of serrations, and one of said stops comprises a snap ring engaging one of said serrations.

6. The apparatus of claim 1, wherein said shaft comprises a plurality of serrations, and one of said stops comprises a snap ring engaging one of said serrations, and said resilient spacer is disposed adjacent said snap ring.

7. The apparatus of claim 1, wherein said resilient spacer comprises a plurality of stacked belleville washers.

8. The apparatus of claim 1, wherein said resilient spacer is adjacent one of said pair of stops, and further comprising another resilient spacer adjacent another of said pair of stops.

9. The apparatus of claim 1, wherein said blender segments form a ribbon blender.

10. The apparatus of claim 1, wherein said blender segments form a ribbon blender having a double helix.

11. A method of fabricating a blender for mixing electrostatographic developer, comprising:

disposing a resilient spacer and a plurality of blender segments on a shaft, each said blender segment having an aperture, said shaft being received within said aperture of each said blender segment; and compressing said resilient spacer and said plurality of blender segments between a pair of stops attached to said shaft.

12. The method of claim 11, further comprising disposing said plurality of blender segments in seriatim with said resilient spacer adjacent one of said pair of stops.

13. The method of claim 11, wherein said shaft comprises a plurality of serrations, and one of said stops comprises a snap ring, and further comprising pressing said snap ring toward another of said stops into engagement with one of said plurality of serrations.

14. The method of claim 13, further comprising disposing said resilient spacer adjacent said snap ring.

15. The method of claim 11, wherein said resilient spacer comprises a plurality of stacked belleville washers.

16. The method of claim 11, wherein said resilient spacer is immediately adjacent one of said pair of stops, and further comprising another resilient spacer immediately adjacent another of said pair of stops.

17. The apparatus of claim 11, wherein said blender segments form a ribbon blender.

18. The apparatus of claim 11, wherein said blender segments form a ribbon blender having a double helix.

19. A blender for mixing electrostatographic developer, comprising:

a shaft having a pair of stops spaced along a length thereof and a plurality of serrations, one of said stops comprising a snap ring engaging one of said serrations;

a plurality of blender segments, each said blender segment having an aperture, said shaft being received within said aperture of each said blender segment; and, at least one belleville washer disposed immediately adjacent one of said stops, wherein said at least one belleville washer and said plurality of blender segments are compressed between said pair of stops.

20. The apparatus of claim 1, wherein said blender segments form a ribbon blender.

* * * * *